US005653100A

United States Patent [19]

Dal Monte

[11] Patent Number: 5,653,100

[45] Date of Patent: Aug. 5, 1997

[54] METHOD OF MANUFACTURING FACETTED-HOLLOW LINK CHAIN AND CHAIN FORMED THEREBY

[75] Inventor: Giuseppe A. Dal Monte, West Hollywood, Calif.

[73] Assignee: Oroamerica, Inc., Burbank, Calif.

[21] Appl. No.: 613,891

[22] Filed: Mar. 11, 1996

[51] Int. Cl.[6] ..... B21L 15/00

[52] U.S. Cl. ..... 59/30; 59/35.1; 59/80

[58] Field of Search ..... 59/29, 30, 35.1, 59/80

[56] References Cited

U.S. PATENT DOCUMENTS

| | | | |
|---|---|---|---|
| 1,053,726 | 2/1913 | Hamm et al. | 59/16 |
| 1,055,751 | 3/1913 | Hurley | 59/16 |
| 4,503,664 | 3/1985 | Allazzetta et al. | 59/16 |
| 4,934,135 | 6/1990 | Rozenwasser | 59/80 |
| 5,471,830 | 12/1995 | Gonzales | 59/80 |
| 5,487,264 | 1/1996 | Strobel | 59/80 |
| 5,535,583 | 7/1996 | Holzer | 59/80 |

*Primary Examiner*—David Jones

[57] ABSTRACT

A method of forming hollow link, facetted chain and the chain formed by the method. The method begins with chain assembled from hollow links having outer wall regions, which links are already soldered together. Generally flattened facets are formed on the hollow link chain by passing the hollow link chain along a longitudinal path, wherein a series of rotating anvils deform inwardly portions of the outer wall regions to thereby form generally flattened facets on at least some of the hollow links to form the hollow link facetted chain.

19 Claims, 4 Drawing Sheets

FIG. 5
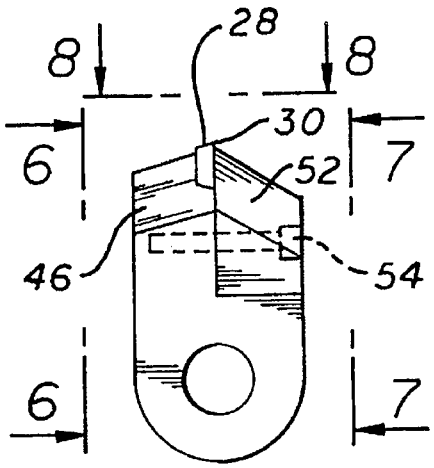
FIG. 6
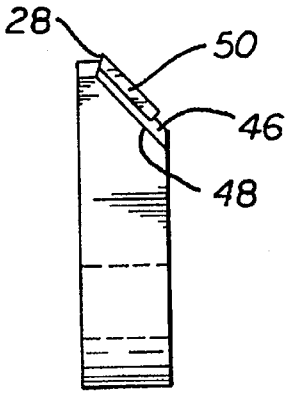
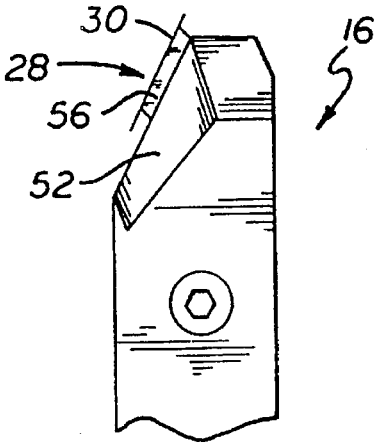
FIG. 7
FIG. 10
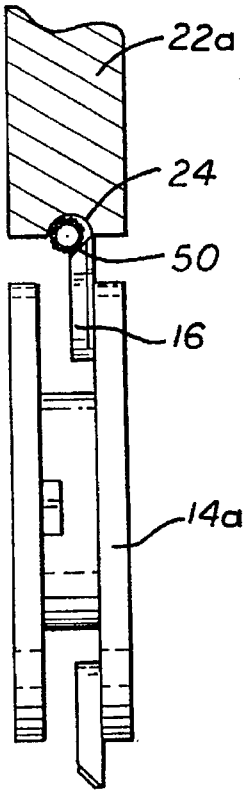
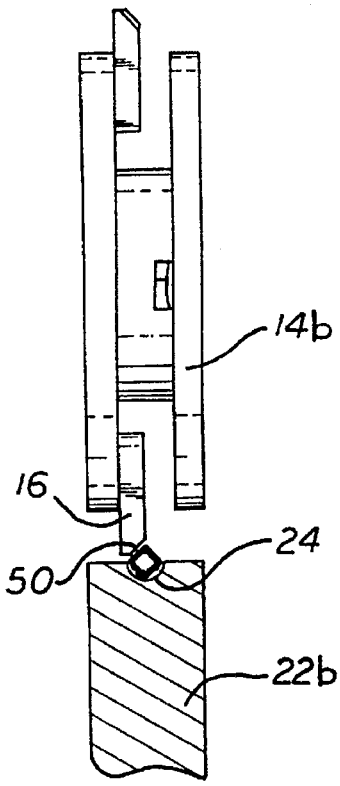
FIG. 12
FIG. 8
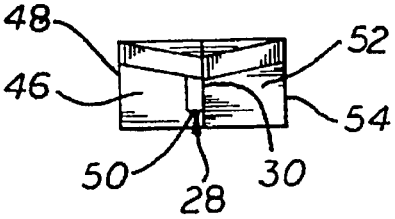

METHOD OF MANUFACTURING FACETTED-HOLLOW LINK CHAIN AND CHAIN FORMED THEREBY

BACKGROUND OF THE INVENTION

1. Field of the Invention

This invention relates to the field of chain, and more specifically to a method of manufacturing hollow link chains and particularly rope chains, having flattened and highly reflective facets formed on exterior surfaces of its links, and the chains formed by the method.

2. Description of the Prior Art

Jewelry rope chain, such as used for necklaces and brackets and the like are made from a helicoid configuration of a large number of individual links, which are interconnected to form a double helix helicoid resembling a rope, and thus are given the term "rope chain." Due to high cost of the precious materials, e.g. gold, platinum, silver, etc. used to form rope chains, manufacturers have made many innovations to reduce the amount of precious material needed to form a rope chain of a given diameter and length. These methods include using hollow wires to form the links assembled into the rope chain, using wires which have unique cross sections to form the individual links, such as taught in U.S. Pat. No. 5,185,995 to Dal Monte, using particular ratios of number of links per turn of the helicoid, such as taught in U.S. Pat. No. 4,651,517 to Benhamou et al.; using overall link shapes, as disclosed in U.S. Pat. No. 4,996,835 to Rozenwasser as well as other innovations and techniques. Balanced against the weight saving concern, is the necessity that the aesthetics of the finished product must not be unduly compromised, and hopefully enhanced, and the often higher laser and/or equipment costs required.

In the last several years so-called "diamond cut" rope chains have been popular. The "diamond-cuts" give the chain numerous facets, which reflect light much as do facets on precious stones, giving the rope chains enhanced sparkle. In the case of rope chains made from solid links, most often the facets are formed by grinding or shearing off some of the material from areas of the links in the assembled rope chain to form the facets.

In cases where hollow links are used, the links in the areas where precious material will be sheared or grinded must be thick enough so that the links will not be excessively thinned or sheared through. U.S. Pat. No. 5,412,935 to Rozenwasser utilizes special hollow links with a ring region of enhanced thickness around its outer perimeter. Portions of this ring region are sheared off when the rope chain is carried on a drum, or is said to be ground off to form the diamond cut facets on the finished rope chain. While the method of Rozenwasser does allow for diamond cutting of the hollow links, the resulting diamond cut rope chain has a different appearance than that of normal diamond cut rope chain. Moreover, the inventor believes the Rozenwasser rope chain would be difficult to manufacture since it requires first forming precious metal plate having an unusual profile with an area of enhanced thickness, and then carefully wrapping this plate around a base metal anvil such that the area of enhanced thickness is positioned on an outer perimeter thereof. These wires are then formed into links which are assembled into rope chains.

In lieu of grinding or shearing hollow links to form hollow facetted rope chains, a methodology has been developed to inwardly deform regions of the hollow rope chain's links to form generally flattened regions, which flattened region art as facets. U.S. Pat. Nos. 5,437,149, 5,353,584, 5,129,220 and 5,125,225 to Strobel et al. disclose this methodology and chains formed by the method. In the Strobel et al. methodology and chain, unfacetted hollow rope chain is wound around a freezing cold drum, and water is applied to freeze the rope chain onto the drum to immobilize the rope chain thereon. A burnishing/hammering tool is then applied longitudinally along an outer line along the drum. As the burnishing to tool is slowly moved longitudinally along the drum, regions of links of the rope chain are deformed inwardly, forming facets thereon. The direction of travel of the burnishing tool is in a direction generally perpendicular (transverse) to the length of the chain, thereby effectively preventing any stretching of the rope chain as it is being burnished or hammered. The rope chain is then removed from the drum, rotated by a certain number of degrees (e.g. by 90 degrees to form a rope chain with facets on four sides, and by 45 degrees to form a rope chain with facets on eight sides) and is rewound on the drum for further facetting. The Strobel et al. process functions well in allowing hollow rope chain to be facetted. However, a considerable amount of skilled labor is involved in carefully positioning and repositioning the rope chain around the drum between the cycles of forming the facets on different sides of the rope chain. The process of drum turning must be closely supervised, requiring that skilled personnel be present during the entire process. While the Strobel et al. process is particularly useful in facetting rope chains, it can also be utilized to form facets on other types of hollow link chains.

In order to understand the methodology of Strobel et al. and of the invention herein, it is helpful to understand how rope chains, both solid of hollow linked, are manufactured. Rope chains, whether formed from hollow or solid link wire, are manufactured using a plurality of individual links with a gap between their two ends. These links gaps are interconnected with or "woven" together with adjacent links gaps offset from each other by 180 degrees. During the assembly of the individual links into the rope chain, a pair of binding wires are twisted around the rope chain in its two helical furrows to hold the links in place. As additional links are added to the growing chain, the binding wires continue to be twisted around the length of rope chain being formed. After a desired length of link wire is formed, most adjacent links in the chain are soldered together. The soldering of some of, but not all of the links to both adjacent links prevents the rope chain from falling apart, yet gives the chain overall flexibility. The binding wires can be steel, copper, or other materials. After the soldering step is completed, the binding wires are removed from the now assembled rope chain. In the case of hollow rope chain, the individual links are made from link wire which has a precious metal plate wrapped around a core of a base metal such as copper, aluminum, iron, etc. If the precious metal plate wraps completely around the base metal core, the link wire is called "seamless". If the precious metal plate does not completely encircle the base metal core, leaving a gap, the link wire is termed "seamed" link wire. The link wire is then formed into individual links by coiling the link wire around a form to establish the desired link shape, e.g. a circle, an oval, a hexagon, etc., and then slicing the coil perpendicular to the coil to form the individual links. After the soldering step and the binding wires are removed, the base metal core in the links of the assembled rope chain is dissolved out by chemical treatment. Acids are typically utilized to dissolve out copper and iron cores and caustic soda functions well to dissolve out aluminum cores. The completed hollow rope chain can then be further manufactured into facetted rope chain by the method of Strobel et al.

As stated above, in the method of Strobel et al., a burnishing tool is applied generally perpendicularly to the length of the rope chain while the completed rope chain is rigidly retained on the drum, to form a series of flattened facets on one side of the chain. Since the rope chain is rigidly frozen to the drum, the rope chain does not move during this process, and the delicate hollow rope chain is prevented from stretching longitudinally and being distorted, which is a problem with hollow rope chain.

Diamond milling machines, such as that model 2300/2T diamond milling machine manufactured by F.O.V., S.A.S, of Vicenza, Italy have been used for forming facets on solid rope chain. In the use of diamond milling machines, solid rope chain which has been completely manufactured, is arranged to travel longitudinally along a path, where it passes over pulleys, exposing one side of the rope chain for diamond cutting, with the other side remaining in contact with the first pulley. Spinning adjacent to a first pulley is a first disk carrying cutting bits which impinge upon the exposed first side of the rope chain, and shear off portions of the link material on the first side of the rope chain, leaving a first series of facets. The cutting bits are often diamond tipped, or made of carbide. The half facetted rope chain then passes onto a second pulley, where the now facetted first side is in contact with the second pulley, and the second, uncut side is exposed. Spinning adjacent to the second pulley is a second disk carrying cutting bits which impinge upon a second side of the rope chain, and shear off portions of the link material on the second side of the rope chain, leaving a second series of facets. The process allows forming all the facets on the rope chain in a single longitudinal pass of the rope chain through the diamond milling machine. The diamond milling machine process for forming solid diamond-cut rope chain using solid rope chain as a starting material is efficient since the diamond milling machines, in general, are fully automated and require little direct supervision by skilled workers.

U.S. Pat. No. 5,471,830 to Gonzales discloses the use of diamond milling machines to form a mirrored finish on a chain with a circular perimeter. Gonzales states that as a final method to form the mirrored finish, cutting tools are oriented such that material will be cut from the outer surface of the chain. However, contrary to the statements in Gonzales, it has been the instant inventor's experience that any attempt to process hollow link chains on diamond milling machines results in the chain being twisted, distorted, and torn apart.

Indeed, while these diamond milling machines, (which employ a dry process in contrast to the Strobel immobilization by freezing process) have proven useful in facetting solid chains of several types, including rope chains, they have not been found useable in forming facetted hollow chains. First, there has previously been no known way of forming the facets on areas of the chain without unduly cutting into the walls of the hollow chain links. Furthermore, since the cutting is in a longitudinal direction, considerable longitudinal stress is put on chains during the facetting process, which in solid chains is fairly well tolerated without unduly stretching of the chain, but which excessively stretches and distorts hollow link chain. Manufacturers would welcome a method to utilize longitudinal diamond milling machines and the like to manufacture facetted hollow link chains, including facetted hollow link rope chain.

SUMMARY OF THE INVENTION

One object of the invention is a method of manufacturing hollow, facetted rope chain using a diamond milling machine.

Another object of the invention is to provide a method of forming hollow link, facetted chain, comprising:

providing a chain assembled from a plurality of hollow link members with outer wall regions;

passing said hollow link chain along a longitudinal path; and deforming portions of said outer wall regions inwardly to thereby form generally flattened regions on at least some of the chain's hollow link members as said hollow rope chain travels on said longitudinal path adjacent impact members which impinge upon outer wall regions of the links and deform them inwardly, thereby forming generally flattened regions.

Yet another object of the invention is to provide method of forming hollow link, facetted rope chain, comprising:

providing a rope chain assembled from a plurality of hollow link members with outer wall regions, said hollow rope chain having binding wires wrapped there around;

passing said rope chain along a longitudinal path while deforming portions of said outer wall regions inwardly to thereby form flattened facets on at least some of the hollow rope chain's link members.

A further subject of the invention is to provide a hollow facetted rope chain formed by:

providing a rope chain assembled from a plurality of hollow link members with outer wall regions, said hollow rope chain having binding wires wrapped there-around; and passing said rope chain along a longitudinal path while deforming portions of said outer wall regions inwardly to thereby form flattened facets on at least some of the hollow rope chain's link members.

BRIEF DESCRIPTION OF THE DRAWINGS

The invention is described below with further reference to the drawings.

FIG. 5 is a side view showing a shearing blade/anvil for attachment to a rotating disk.

FIG. 6 is a front view of the shearing blade/anvil of FIG. 5.

FIG. 7 is a rear view of the shearing blade/anvil of FIG. 5.

FIG. 8 is a top view of the shearing blade/anvil of FIG. 5.

FIG. 10 is a cross-sectional view through view lines 10—10 of FIG. 1 of the rope chain having flattened facets being formed on a first half, by anvils carried on the first disk.

FIG. 12 is a cross-sectional view through view lines 12—12 of FIG. 1 of the rope chain having flattened facets being formed on a second half, by anvils carried on the second disk.

DESCRIPTION OF THE PREFERRED EMBODIMENT

Figure 1:
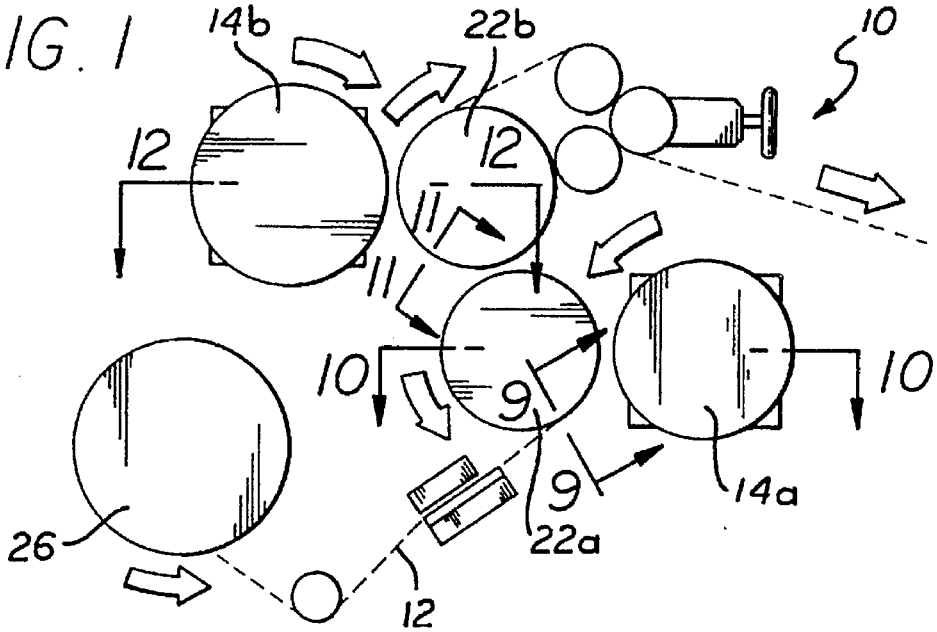
FIG. 1 is a schematic view of a diamond milling machine, used in prior art and in the new method of the invention to create facets on portions of the links of a rope chain by flattening outer portions of the rope chain's links.
Figure 2A:
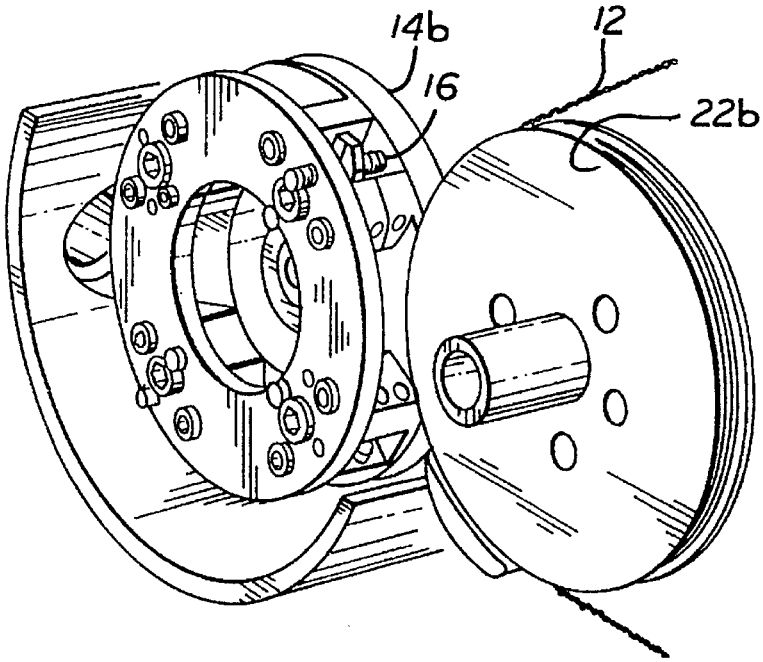
FIG. 2A is a front perspective view of a first pulley and first cutting disk of the diamond milling machine of FIG. 1.

Referring to FIG. 1, a schematic drawing of a diamond milling machine 10, such as available from F.O.V, S.A.S, of Vicenza, Italy, is shown being used to form facets on a chain 12 as the chain 12 travels longitudinally therethrough. Referring to FIG. 2A and 2B, in the prior art, the diamond milling machine 10 has rotating disks 14*a* and 14*b* which carry replaceable diamond or carbide tipped anvils or bits 16 which when rotated on the disks 14*a* and 14*b* at a very high rate of speed will impinge upon and shear off material 18 to form flattened facets 20 on the solid chain 12. The solid link chain 12 is carried on pulleys 22*a* and 22*b* of the diamond milling machine 10 with a groove 24 formed therearound in which the chain 12 is carried. Unfacetted rope chain 12 is carried on a spool 26. As it passes by the rotating disk 14*a* with diamond tipped blades 16, it is facetted on a first half. As the now half facetted rope chain 12 passes further upstream, it passes over to the second pulley 22*b*, where its unfacetted half is now exposed for facetting on a second side by the blade 16 on the rotating disk 14*b*. The facetting process of the entire solid chain 12 is thus completed.

Figure 2C:
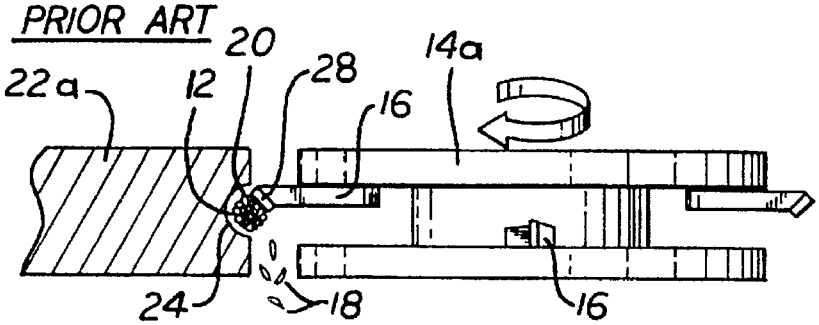
FIG 2C PRIOR ART
FIG. 2C is a cross-sectional view through view lines 2C—2C of FIG. 2B showing how the prior art method is utilized to form facetted solid diamond cut rope chain.
Figure 2B:
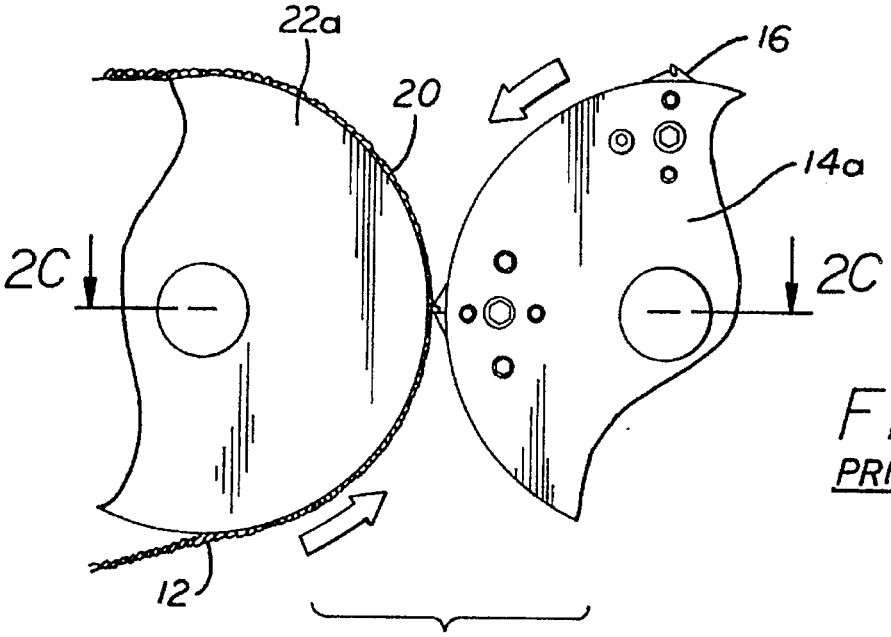
FIG. 2B PRIOR ART
FIG. 2B is a front view of a first pulley and first cutting disk of the diamond milling machine of FIG. 1.

As shown in FIGS. 2A, 2B and 2C, as the diamond tipped bits 16 rotate on the rotating disk 14*a*, their sharp diamond bits 16 are oriented on the rotating disk 16 such that the diamond blades 28 cutting edge 30 impinge on the outer wall of the chain's links 12, and shear off material 18.

Figure 3:
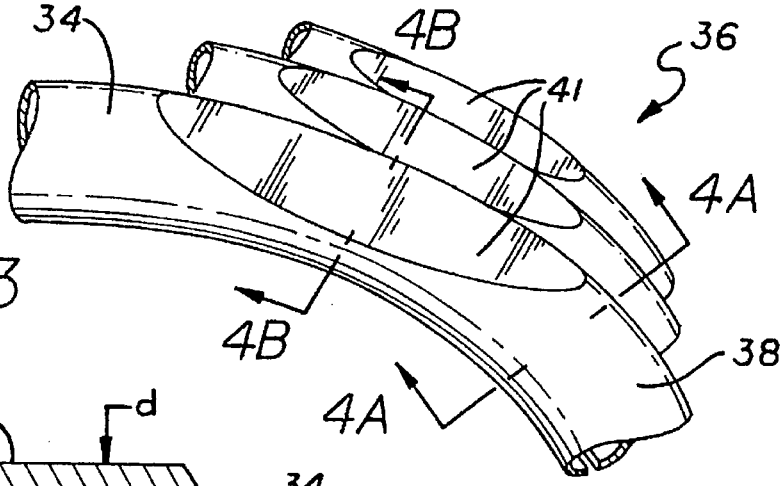
FIG. 3 is a perspective view showing flattened facets formed on outer walls of the hollow links of a section of rope chain.
Figure 4B:
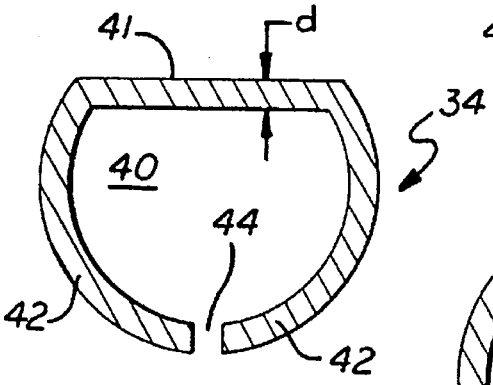
FIG. 4B is a cross-sectional view through view lines 4B—4B of FIG. 3 showing the flattened facets formed on a section of a hollow link.
Figure 4A:
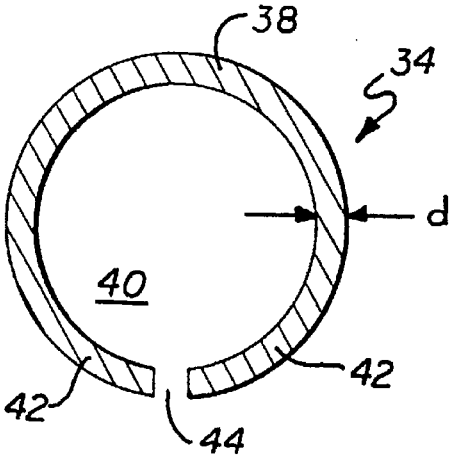
FIG. 4A is a cross-sectional view through view lines 4A—4A of FIG. 3 showing the unfacetted regions of a hollow link.

Referring now to FIG. 3, a partially exposed perspective view of hollow links 34 of a hollow link rope chain 36 is shown. Referring to FIGS. 4A and 4B, the hollow links 34 have an outer wall region 38 of a thickness "d," and the links have an interior void region 40. The flattened "facet" portion 41 comprise areas of the outer wall region 38 which have been generally flattened, and pushed inwardly toward inner wall regions 42. In the non-facetted area of the link 34 as shown in FIGS. 3 and 4A, the cross-sectional shape of the links 36 remains unaffected.

The outer wall region 38 lies generally around an outer perimeter portion of each link 34 and the inner wall region 42 generally lies around an inner perimeter of each link 34. In FIGS. 3, 4A and 4B, the hollow links 34 are depicted as being seamed links with a gap opening 44, but the hollow links 34 can also be seamless, without a gap opening. Also, while the hollow link wires 34 are depicted as being a circular cross-section, they can have other cross-sectioned shapes as oval, triangular, and other shapes.

In reference to FIGS. 5–8, various views of a conventional diamond tipped bit/anvil 16 used to both shear off material in the prior art and to form flattened facets 41 on the outer surface 38 of the hollow links 34 of the chain 36 are shown. Each diamond bit 16 carries a diamond blade 28 with a cutting edge 30. The diamond blade 28 is mounted on a side 46 of the bit 16. Referring to FIG. 6, which is a front view of bit 16, the leading face 46 of the bit is slanted upwardly from a front edge 48 of the bit 16. The diamond blade 28 is fixed in the leading face 46 with a smooth transition between the diamond blade's face 50 and the leading face 46 of the bit 16. The bit has a trailing face 52 which slants downwardly from the diamond blade's cutting edge 30 to a rear edge 54 of the bit.

Referring to FIG. 7, the diamond blade's cutting tip 30 is raised up relative to the trailing face 52 of the bit 16. This defines a shoulder 56. When the diamond tipped bit/anvil 16 is attached to the rotating disk 14*a* and 14*b* such that the shoulder 56 strikes the outer wall 38 of a link 34 first, shearing of material will take place. However, by attaching the diamond tipped bit/anvil 16 on the rotating disks 14*a* and 14*b* such that the slanted face 50 of the cutting blade 28 strikes the outer wall region 38 of the a hollow link 34 first, the outer wall region 38 being striked will deform inwardly, to form flattened facets 41. FIGS. 5–8 show one of a pair of a diamond tipped bit/anvil 16. Referring to FIGS. 10 and 12, a mirror imaged diamond tipped bit/anvil 16*b* will also be provided to form additional flattened facets.

Since the diamond blades face 50 is extremely flat and smooth, as the diamond blade 28 tangentially impacts the outer walls 38 of the hollow links 34, they cause highly polished and flat indented facets 41 to be formed thereon. Moreover, since the force of the rapidly rotated bits 16 tend to push down on the hollow rope chain's links 34, any slight misalignment of the rope chain's links 34 relative to other links 36 in the chain 36 will not result in the chain's link be twisted or destroyed. In addition to utilizing readily available conventional diamond cutting bits/anvil 16, other specialized anvils without cutting edges or diamond bits can also be used.

Figure 9:
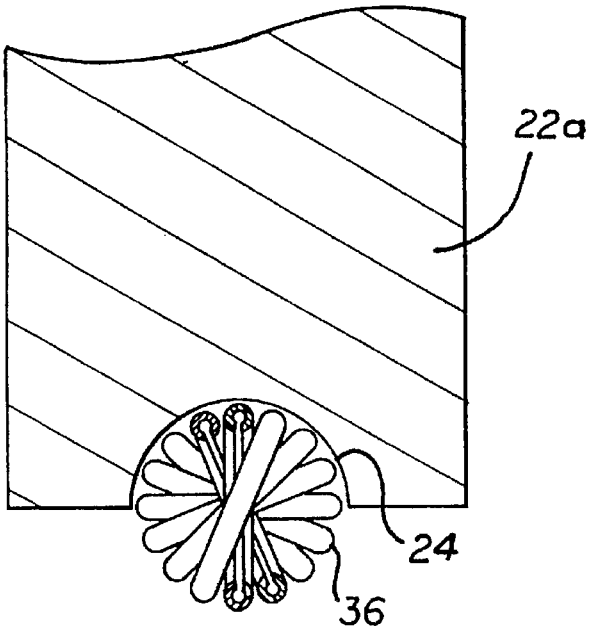
FIG. 9 is a cross-sectional view of the unfacetted rope chain carried on a first pulley through view lines 9—9 of FIG. 1.

FIG. 9 is a cross-sectional view through view line 9—9 of FIG. 1 showing the as of yet unfacetted hollow chain 36 wrapped around a first pulley 22*a*, retained in a circumferential groove 24 formed therearound. FIG. 10 is a cross-sectional view through view lines 10—10 of FIG. 1, showing a first cross-sectional half of the chain 36 having facets 41 being formed therein by virtue of the chain 36 being carried on the first pulley 22*a* with the bits 16 on the rotating disk 14*a* placed adjacent to the first pulley 22*a* and the carried chain 36, such that the rotating bit's slanting diamond face 50 will impinge on a first, exposed cross-sectional half Of the chain 36, and cause selected outer wall regions 34 to be compressed inwardly closer to the inner wall region 42, to form the facets 41 thereon, as shown in FIGS. 3, 4A and 4B.

Figure 11:
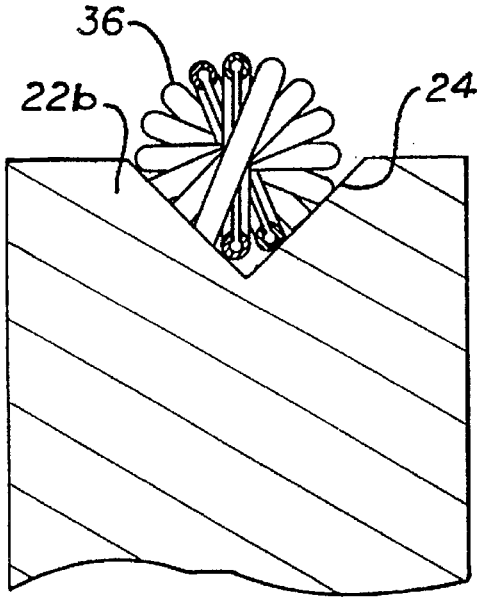
FIG. 11 is a cross-sectional view through view lines 11—11 of FIG. 1 of the rope chain, now facetted on a first half, carried on a second pulley.

FIG. 11 is a cross-sectional view through view lines 12—12 showing the now half facetted hollow link chain 36 wrapped around a second pulley 22*b*, with its unfacetted second cross-sectional half being exposed for facetted. FIG. 12 is a cross-sectional view showing the second cross-sectional half of the chain 36 having facets 41 being formed therein by virtue of the chain 36 being carried on the second pulley 22*b* with the bits 16 on rotating disk 14*b* placed adjacent to the second pulley bits 16 22*b* and the carried rope chain 36, such that slanted face 50 the rotating bit's blades 28 will impinge on the chain 36 on the second cross-sectional half of the rope chain 36, and cause selected outer wall regions 34 to be compressed inwardly toward the inner wall region 42, to form additional facets 41. If a chain with facets formed on six or eight sides is desired, then rotating disks will preferably carry additional bits 16, or the chain 36 can be run through the process again, as desired.

The force of the rapidly rotating bits 16 impinging longitudinally upon the hollow link chain's 36 hollow links 34 causes significant longitudinal stress being placed on the hollow link chain 36. In certain styles of chain, such as rope chain, if the chain 36 is otherwise not prevented from being stretched, this longitudinal striking force causes undue stretching and distortion of the hollow chain 36, which is enough to destroy the chain 36.

Figure 13:
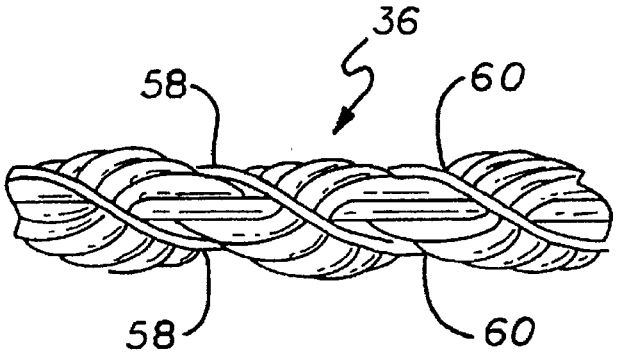
FIG. 13 is a perspective view of unfacetted rope chain, with its links already soldered together, but with binding wire still wrapped in furrows in the double helicoid.
Figure 14:
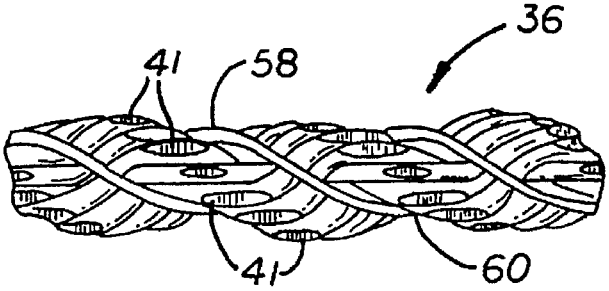
FIG. 14 is a perspective view of hollow rope chain, after being facetting and with binding wire still wrapped in furrows in the double helicoid.

Referring to FIGS. 13 and 14, the Applicant has found that by leaving the pair of binding wires 58 still wrapped around the spiralling furrows 60 of the already soldered and chemically treated chain 36 (to dissolve out the base metal core from the hollow links 34), the hollow link chain 36 can withstand the forces of longitudinal facetting as described above, without stretching and without being destroyed. After the chain 36 is facetted by this method, the pair or twisted binding wires 58 can be removed by untwisting them, and/or in the case of copper binding wires, dissolving them, as required. Since twisted binding wires 58 must be wrapped around the plurality of links in the spiralling furrows 60 as they are woven together to hold them for soldering, waiting until after the facetting process is completed to remove the binding wires 58 does not introduce any extra steps, yet results in a manufacturer being able to use a conventional, diamond milling machine 10 to create a hollow, facetted chain 36, in a longitudinal manner. Furthermore, since the longitudinal facetting method can be accomplished in a largely automated and unsupervised manner, substantial labor savings can be achieved. FIG. 14 depicts the hollow link chain 36 after it has been facetted, with the binding wires 58 still twisted therearound.

While the use of generally flattened facets has been described above, the term flattened is also intended to encompass situations wherein portions of the outer periphery of the chain are deformed inwardly, to flatten them, but not necessarily form flat areas.

While the method of the invention has been described with reference to the use of the F.O.V., S.A.S diamond milling machine, other machines which accomplish deformation of a hollow rope chain as it travels in a longitudinal direction can also be used.

The methodology described herein of leaving the binding wires wrapped around the hollow link chain will function quite well to form facetted hollow link rope chain. The method of the invention is also applicable to other styles of non-rope hollow link chain, which chains are not always as frangible as rope chains, and can be facetted without using binding wires.

The drawings and the foregoing description are not intended to represent the only form of the invention in regard to the details of this construction and manner of operation. In fact, it will be evident to one skilled in the art that modifications and variations may be made without departing from the spirit and scope of the invention. Although specific terms have been employed, they are intended in a generic and descriptive sense only and not for the purpose of limitation, the scope of the invention being delineated in the following the claims which follow.

I claim:

1. A method of forming hollow link, facetted, flexible, jewelry chain, comprising:

providing a flexible jewelry chain assembled from a plurality of hollow link members with outer wall regions, wherein only some of said link members are soldered to adjacent link members, said flexible chain being further provided with binding wire wrapped therearound;

passing said flexible chain along a longitudinal path;

deforming portions of said outer wall regions of said flexible chain inwardly to thereby form generally flattened regions on at least some of the chain's hollow link members as said hollow rope chain travels on said longitudinal path adjacent impact members which impinge upon outer wall regions of the links and deform them inwardly, thereby forming generally flattened regions on at least some of the hollow rope chain's link members, and wherein said binding wire resists stretching of said chain; and removing said binding wire after the step of deforming portions of said outer wall regions.

2. The method of forming hollow link, facetted, flexible, jewelry chain of claim 1, wherein said flexible chain is facetted as it is carried on at least one pulley, adjacent at least one of said impact members.

3. The method of forming hollow link, facetted, flexible, jewelry chain of claim 2, wherein said step of deforming portions of said outer wall portions inwardly to thereby form generally flattened regions on at least some of the hollow link members is carried out on a diamond milling machine.

4. The method of forming hollow link, facetted jewelry chain of claim 3, wherein said deformation of said outer wall regions of said flexible chain is provided in a single pass through said diamond milling machine.

5. The method of forming hollow link, facetted chain of claim 3, wherein each said impact member comprises at least one cutting bit attached to a rotating disk, said at least one cutting bit having a cutting blade with an upwardly slanted face, wherein said cutting blade is oriented on the roatating disk such that the upwardly slanted face impacts regions of said hollow rope chain links to thereby inwardly deform portions of said links outer wall regions to form flattened facets thereon.

6. The method of forming hollow link, facetted jewelry chain of claim 1, wherein said hollow link chain has had a core of material removed from its hollow links prior to the deforming step.

7. The method of forming hollow link, facetted chain of claim 1, wherein said chain is a rope chain.

8. The method of forming hollow link, facetted, flexible, jewelry chain of claim 7, wherein said rope chain has furrows, with said binding wire wrapped around said furrows of said rope chain, and wherein said binding wire is removed after deforming portions of said outer wall regions.

9. The method of forming hollow link, facetted, flexible, jewelry chain of claim 1, wherein said hollow link chain is facetted on one of four, six and eight sides.

10. The hollow link, facetted, flexible, jewelry chain formed by the method of claim 1.

11. A method of forming hollow link, facetted, flexible, jewelry rope chain, comprising:

providing a partially soldered rope chain assembled from a plurality of hollow link members with outer wall regions, said rope chain having binding wires wrapped therearound;

passing said rope chain along a longitudinal path while deforming portions of said outer wall regions inwardly to thereby form generally flattened facets on at least some of the hollow rope chain's link members; and removing said binding wires after deforming portions of said outer wall regions.

12. The method of forming hollow link, facetted rope chain of claim 11, wherein said step of deforming portions of said outer wall regions is accomplished as said hollow rope chain travels on pulleys adjacent impact members which impinge upon outer wall regions of the links and deform them inwardly, thereby forming said generally flattened facets.

13. The method of forming hollow link, facetted rope chain of claim 11, wherein said step of deforming portions of said outer wall portions inwardly to thereby form facets on at least some of the hollow rope chain's link members is carried out on a diamond milling machine.

14. The method of forming hollow link, facetted rope chain of claim 14, wherein each said impact member comprises at least one cutting bit attached to a rotating disk, said at least one cutting bit having a cutting blade with a slanted face, wherein said cutting blade on the rotating disk is oriented such that the slated face impacts outer wall regions of the said hollow rope chain's links to thereby inwardly deform portions of said links outer wall regions, thereby forming flattened facets thereon.

15. The method of forming hollow link, facetted rope chain of claim 11, wherein said hollow rope chain has had at least some of its links soldered together and has had a core removed from its links.

16. The method of forming hollow link, facetted rope chain of claim 11, further comprising the step of removing the binding wires after said facets are formed on said hollow link rope chain.

17. The method of forming hollow link, facetted rope chain of claim 11, wherein said hollow rope chain is facetted on one of four, six and eight sides.

18. A hollow, facetted, flexible, jewelry rope chain formed by the method of claim 11.

19. A method of forming hollow link, facetted, flexible, jewelry chain, comprising:

providing a partially soldered flexible jewelry chain assembled from a plurality of hollow link members with outer wall regions, said jewelry chain having binding wires wrapped therearound;

passing said jewelry chain along a longitudinal path while deforming portions of said outer wall regions inwardly to thereby form generally flattened facets on at least some of said hollow link members, and wherein said binding wires resist stretching of said jewelry chain; and removing said binding wires after said step of deforming portions of said outer wall regions.

* * * * *

UNITED STATES PATENT AND TRADEMARK OFFICE

CERTIFICATE OF CORRECTION

PATENT NO. : 5,653,100
DATED : August 5, 1997
INVENTOR(S) : Giuseppe A. Del Monte It is certified that error appears in the above-identified patent and that said Letters Patent is hereby corrected as shown below:

Column 6, Line 67, after "bits", delete "16 22b".

Column 9, Claim 14, Line 20, change "14", to read --11--.

Signed and Sealed this

Thirtieth Day of December, 1997

*Attest:*

*Attesting Officer*

Bruce Lehman

BRUCE LEHMAN

*Commissioner of Patents and Trademarks*